US008371234B2

(12) United States Patent
Rodet et al.

(10) Patent No.: US 8,371,234 B2
(45) **Date of Patent: *Feb. 12, 2013**

(54) BOGIE FOR RAILWAY VEHICLE

(75) Inventors: Alain Rodet, Chalon sur Saone (FR); Christophe Eche, Montchanin (FR); Yves Longueville, Torcy (FR)

(73) Assignee: Alstom Transport SA, Levallois-Perret (FR)

( * ) Notice: Subject to any disclaimer, the term of this patent is extended or adjusted under 35 U.S.C. 154(b) by 330 days.

This patent is subject to a terminal disclaimer.

(21) Appl. No.: 12/594,804

(22) PCT Filed: Mar. 18, 2008

(86) PCT No.: PCT/FR2008/050442

§ 371 (c)(1),
(2), (4) Date: Feb. 16, 2010

(87) PCT Pub. No.: WO2008/132361

PCT Pub. Date: Nov. 6, 2008

(65) Prior Publication Data

US 2010/0186620 A1 Jul. 29, 2010

(30) Foreign Application Priority Data

Apr. 5, 2007 (FR) ..... 07 54306

(51) Int. Cl.
*B61F 3/00* (2006.01)

(52) U.S. Cl. ..... 105/182.1

(58) Field of Classification Search ..... 105/3, 4.1–4.3, 105/34.1, 34.2, 96, 96.1, 157.1, 182.1, 329.1, 105/330, 342, 344, 397

See application file for complete search history.

(56) References Cited

U.S. PATENT DOCUMENTS

| | | | | |
|---|---|---|---|---|
| 3,539,170 | A | 11/1970 | Hamel et al. | 267/63 |
| 4,867,072 | A * | 9/1989 | Kleim et al. | 105/133 |
| 5,415,107 | A * | 5/1995 | Tutzauer | 105/218.2 |
| 6,418,859 | B1 * | 7/2002 | Hentschel et al. | 105/167 |
| 6,601,520 | B2 * | 8/2003 | Eche et al. | 105/34.1 |

(Continued)

FOREIGN PATENT DOCUMENTS

| | | |
|---|---|---|
| BE | 418575 A | 7/1936 |
| DE | 1804605 A1 | 12/1969 |

(Continued)

OTHER PUBLICATIONS

International Search Report of corresponding PCT/FR2008/050442.

*Primary Examiner* — Robert McCarry, Jr.
(74) *Attorney, Agent, or Firm* — Davidson, Davidson & Kappel, LLC

(57) ABSTRACT

A bogie for a railway vehicle including a chassis; two front wheels and two rear wheels; and for each front wheel and each rear wheel, a guide for guiding the wheel in rotation and a primary suspension device of the chassis on the guide is provided. At least the primary suspension devices associated with the front and rear wheels arranged on the same first lateral side of the bogie each include two longitudinal connecting rods, each connected to the chassis by a first connection point and to the corresponding guide by a second connection point, and at least one resilient component inserted between the two connecting rods to define at least the vertical stiffness of the primary suspension device, the two connecting rods being offset longitudinally from one another.

24 Claims, 13 Drawing Sheets

U.S. PATENT DOCUMENTS

| | | | | |
|---|---|---|---|---|
| 6,772,698 | B2 * | 8/2004 | Ueta et al. | 105/3 |
| 6,945,176 | B2 * | 9/2005 | Santti et al. | 105/3 |

FOREIGN PATENT DOCUMENTS

| | | | |
|---|---|---|---|
| EP | 0326179 | A | 8/1989 |
| EP | 0911239 | | 4/1999 |
| FR | 0600834 | | 7/1925 |
| FR | 1536401 | | 8/1968 |
| GB | 475625 | A | 11/1937 |
| WO | WO 0064721 | A | 11/2000 |

* cited by examiner

BOGIE FOR RAILWAY VEHICLE

This claims priority to French Application No. 07 54306, filed Apr. 5, 2007 through international application PCT/FR2008/050442, filed Mar. 14, 2008, the entire disclosures of which are hereby incorporated by reference herein.

The invention relates in general to railway vehicles, particularly trams.

More specifically, according to a first aspect, the invention relates to a bogie for a railway vehicle, the bogie being of the type comprising:

a chassis;

two front wheels and two rear wheels;

for each front wheel and each rear wheel, guidance means for guiding said wheel in rotation and a primary suspension device of the chassis on said guidance means.

BACKGROUND OF THE INVENTION

Such a bogie is known from document WO-00/64721, which describes a tram comprising a body and at least one powered bogie of this type. The side members of the bogie chassis are placed immediately inside the wheels, the motors driving the wheels being placed outside the bogie relative to the wheels.

Such a bogie has the advantage of allowing a low central corridor to be arranged in the chassis of the body, allowing access without a step to the entire tram. The low central corridor passes between the side members of the bogie chassis.

This bogie cannot easily be mounted by pivot connection means beneath the body. In fact, it would in that case be necessary to reduce the width of the central corridor so as to form spaces between said low central corridor and the side members, to allow clearance of the bogie relative to the body. The corridor would then become so narrow that it would no longer be possible to travel through it with a wheelchair for a disabled person or a pushchair.

SUMMARY OF THE INVENTION

Within this context, the object of the invention is to propose a bogie allowing a low, wide corridor to be arranged in the chassis of the body, irrespective of how the body is connected to the bogie.

For this purpose, the invention relates to a bogie of the above-mentioned type, characterised in that at least the primary suspension devices associated with the front and rear wheels provided on the same first lateral side of the bogie each comprise:

two longitudinal connecting rods, each connected to the chassis by a first connection point and to the corresponding guidance means by a second connection point.

at least one resilient component inserted between the two connecting rods to define at least the vertical stiffness of the primary suspension device, the two connecting rods being offset longitudinally from one another.

The bogie may also exhibit one or more of the features below, taken individually or in any of the technically possible combination:

in each of said primary suspension devices, the two connecting rods are substantially parallel to one another and are of substantially the same longitudinal length between the respective first and second connection points thereof;

in each of said primary suspension devices, the or each resilient component is a sandwich comprising a plurality of layers of a resilient material and a plurality of metal plates inserted between the layers of resilient material and adhering to said resilient layers;

in each of said primary suspension devices, the or each resilient component has an axis of compression forming an angle $\beta$ of between 0° and 90° relative to an axis passing through the first connection points of the two connecting rods;

in each of said primary suspension devices, each of the two connecting rods is connected to the guidance means corresponding to the second connection point thereof by a resilient cylindrical articulation, and to the chassis by the first connection point thereof, likewise by a resilient cylindrical articulation;

the two connecting rods of each of said primary suspension devices are arranged at a vertical level lower than the highest point of the corresponding guidance means;

each primary suspension device is arranged on a side of the associated wheel facing the inside of the bogie;

the chassis comprises two longitudinal side members arranged towards the inside of the bogie relative to the wheels;

the side members and the guidance means of the wheels are arranged substantially in the same plane parallel to the rolling plane of the bogie;

each side member extends between two guidance means, said side member having front and rear end portions aligned with and terminating longitudinally at a distance from the two guidance means.

the bogie comprises at least one motor and a device suitable for coupling in rotation at least one wheel of the bogie to the motor, the or each motor and the coupling device being arranged towards the outside of the bogie relative to the wheels;

the bogie comprises two motors and two devices each suitable for coupling in rotation a pair of bogie wheels to a motor, one of the two motors and one of the two coupling devices being arranged towards the outside of the bogie relative to the wheels situated on the first lateral side of the bogie, the other of the two motors and the other of the two coupling devices being arranged outside the bogie relative to the wheels situated opposite the first lateral side of the bogie;

one of the two motors is coupled to the two front wheels and the other of the two motors is coupled to the two rear wheels;

the bogie comprises at least one motor, coupling means of the front wheels to the or a motor, and coupling means of the rear wheels to the or a motor, the or each motor and the front and rear coupling means being arranged between, on the one hand, a longitudinal plane midway between the two front wheels and midway between the two rear wheels and, on the other hand, a longitudinal plane passing through the front wheel and the rear wheel situated on the second lateral side of the bogie;

the front and rear coupling means are arranged in positions symmetrical to one another about a median transverse plane of the front and rear wheels;

the bogie comprises a single driving motor aligned longitudinally between the front and rear coupling means;

the bogie comprises front and rear wheel braking elements and secondary suspension components suitable for suspending a railway vehicle body on the bogie chassis, the braking elements and the secondary suspension components being positioned outside the bogie relative to the wheels;

the side member on the second lateral side of the bogie comprises a central portion extending along the motor and two end portions situated, relative to the rolling plane of the bogie, at a higher level than the central portion, the end portions extending above the means for guiding in rotation the wheels situated on the second lateral side of the bogie, the motor being situated at a level lower than that of the end portions relative to the rolling plane of the bogie;

the side member situated on the first lateral side of the bogie and the guidance means of the wheels situated on the first lateral side of the bogie extend substantially in the same plane parallel to the rolling plane of the bogie; and the bogie comprises pivot connection means suitable for connecting the bogie to the body of the railway vehicle.

According to a second aspect, the invention relates to a railway vehicle comprising at least one bogie as described above.

BRIEF DESCRIPTION OF THE DRAWINGS

Other features and advantages of the invention will emerge from the description given below, for guidance and not by way of limitation, with reference to the accompanying drawings in which.

DETAILED DESCRIPTION

In the description that follows, left and right, front and rear should be understood relative to the normal direction of travel of the tram.

Figure 1:
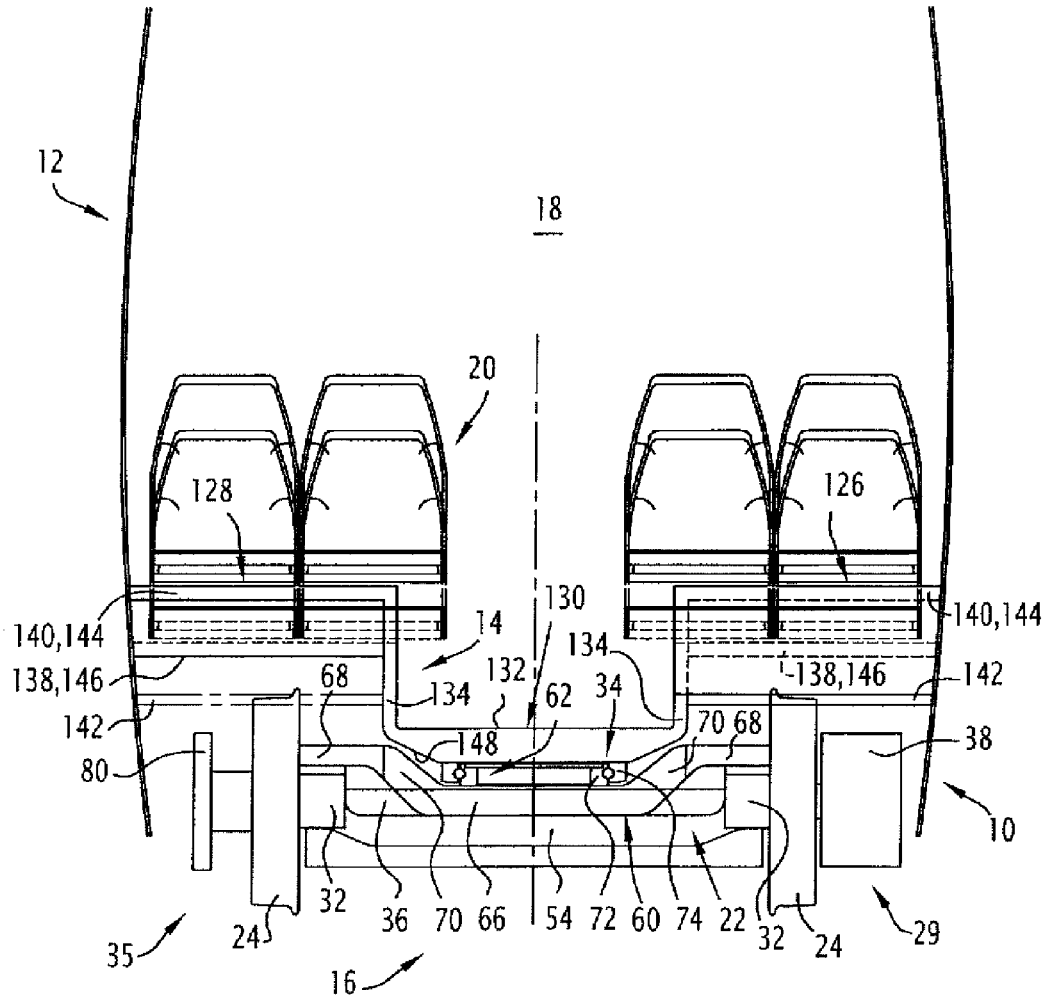
FIG. 1 is a cross-sectional view of a powered, pivoting tram bogie according to a first embodiment of the invention, the body of the tram also being illustrated, and the elements of the body and the bogie being sectioned along different planes for greater clarity.
Figure 2:
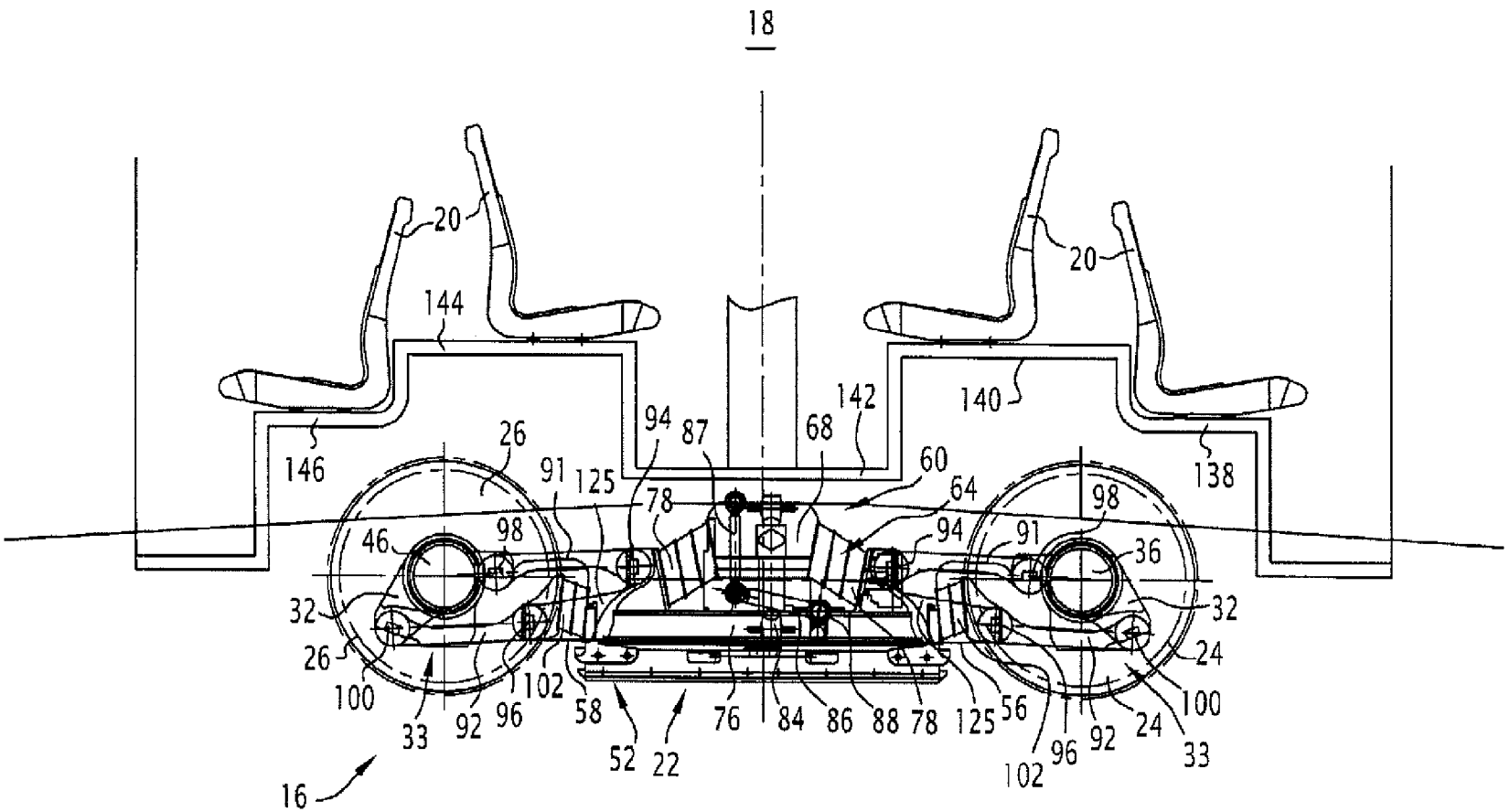
FIG. 2 is a partial in longitudinal sectional view of the bogie and the body of FIG. 1.

The tram 10 illustrated in part in FIGS. 1 and 2 comprises a body 12 provided with a body chassis 14, and for example two bogies 16, each connected to the body 12 and arranged beneath the chassis 14. The body 12 is of a shape which is elongate along a principal direction. It comprises an inner space for passengers 18, delimited towards the bottom by the chassis 14, and seats 20 attached to the chassis 14. The seats 20 are typically arranged in several rows extending perpendicular to the principal direction. The seats are oriented in such a way that the passengers seated in the seats are looking in the principal direction.

The bogies 16 are suitable for supporting and guiding the body 12 when the tram travels along a track.

Figure 3:
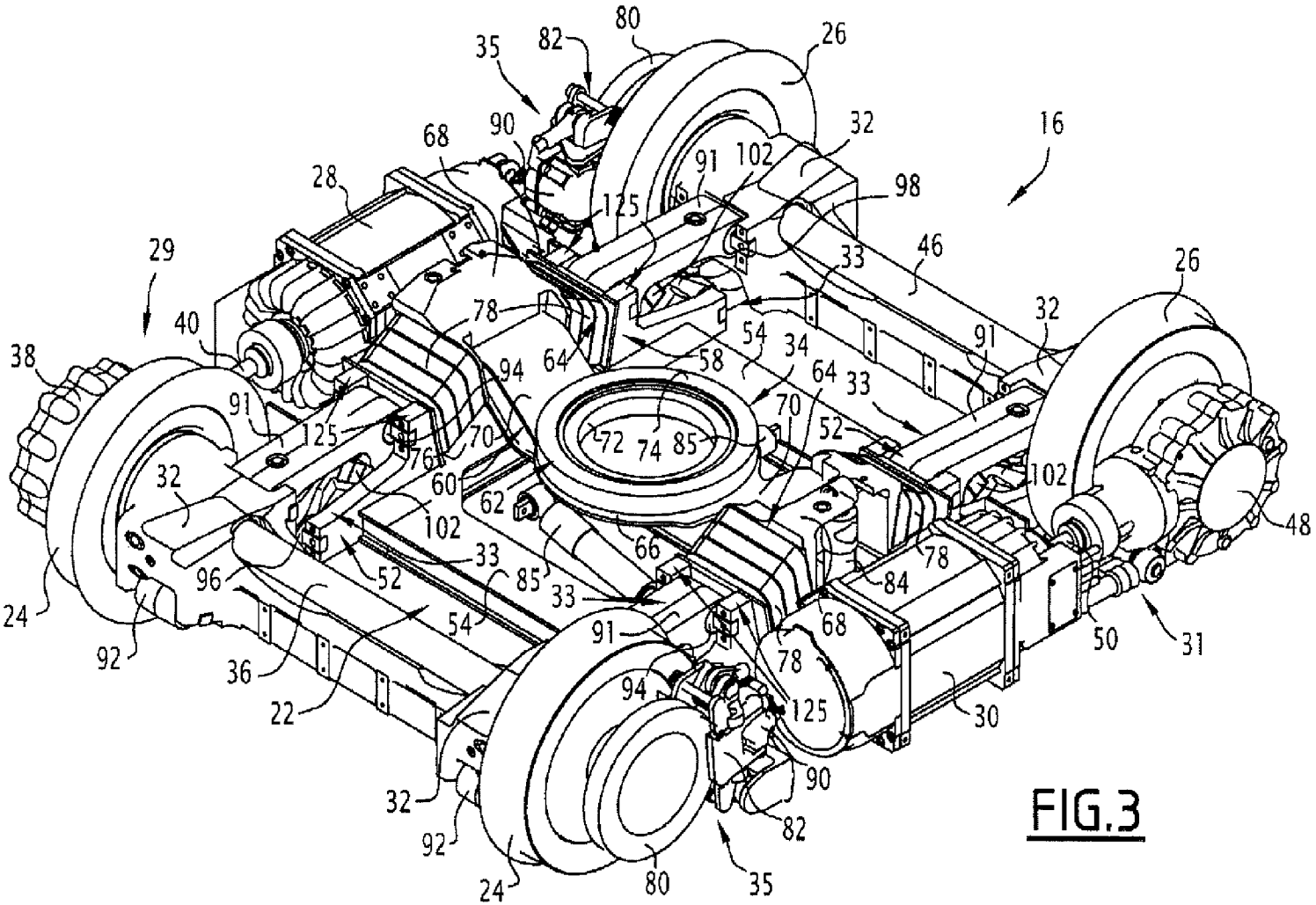
FIG. 3 is a perspective view of the bogie of FIG. 1, the reducing gears not being illustrated for greater clarity.

In a first embodiment of the invention, each bogie comprises, as shown in FIG. 3:

a bogie chassis 22;

two front wheels 24 and two rear wheels 26;

a motor 28 for driving the front wheels 24 and means 29 suitable for coupling the motor 28 to the front wheels 24;

a motor 30 for driving the rear wheels 26 and means 31 suitable for coupling the motor 30 to the rear wheels 26;

for each front wheel 24 and each rear wheel 26, an axle box 32 and a primary suspension device 33 of the chassis 22 on said axle box;

pivot connection means 34 suitable for connecting the bogie 16 to the body 12;

front and rear brakes 35.

The front wheels 24 are coaxial, spaced transversely from one another, and are connected to the chassis 22. Similarly, the rear wheels 26 are coaxial, spaced transversely from one another, and connected to the chassis 22. The front wheels 24 are spaced longitudinally from the rear wheels 26.

The front coupling means 29 comprise for example a front axle 36 connecting the front wheels 24 to one another in rotation, a front reducing gear 38 and a front coupling 40 inserted between the front motor 28 and the front reducing gear 38.

The reducing gear 38 comprises an input connected in rotation to the motor shaft 28 by means of the coupling 40, and an output attached directly to a front wheel 24. The motor shaft 28 extends longitudinally, the coupling 40 comprising typically a longitudinally oriented transmission shaft connected in rotation by universal joints to the shaft of the motor and the input of the reducing gear 38.

The rear coupling means 31 are of the same type as the front transmission means 29, and also comprise a rear axle 46 connecting the two rear wheels 26 to one another in rotation, a rear reducing gear 48 and a rear coupling 50 inserted between the rear motor 30 and the reducing gear 48.

Each of the axles 36 and 46 is guided in rotation by two axle boxes 32, arranged directly inside the wheels associated with the axle, and extending only over a portion of the transverse length of the axle. Each axle passes through the two axle boxes 32 and is guided in rotation inside said axle boxes by bearings, for example ball bearings.

The chassis 22 comprises two longitudinal side members 52 substantially parallel to one another, and at least two transverse cross members 54 substantially parallel to one another, positively connecting the two side members to one another.

The longitudinal side members 52 and the axle boxes 32 are arranged substantially in the same plane parallel to the rolling plane. Each side member extends longitudinally between two axle boxes 32 associated with the front wheel and the rear wheel situated on the same lateral side of the bogie. Each side member 52 has front and rear end portions, 56 and 58 respectively, aligned with and terminating longitudinally at a distance from the two axle boxes 32. These front and rear end portions 56 and 58 are connected to the axle boxes 32 by the primary suspension devices 33.

The motors 28 and 30 are attached rigidly on the chassis 22 of the bogie. The motor for driving the front wheels 28 is arranged on the right lateral side of the bogie. The motor 28, the reducing gear 38 and the coupling 40 are arranged towards the outside of bogie relative to the right front 24 and rear 26 wheels. The motor 28 is substantially equidistant from the front and rear axles 36 and 46. The front reducing gear 38 is arranged in the transverse extension of the front axle 36.

The driving motor of the rear wheels 30, the rear reducing gear 48 and the rear coupling 50 are arranged symmetrically on the left lateral side of the bogie, towards the outside of the bogie relative to the left front and rear wheels. The motor 30 is also equidistant from the front and rear axles 36 and 46. The rear reducing gear 48 is placed in the extension of the rear axle 46.

The pivot connection means 34 between the bogie and the body comprise a bogie bolster 60, a ring 62 inserted between the body chassis 14 and the bogie bolster 60, and secondary suspension components 64 of the bogie bolster 60 on the bogie chassis 22. The bogie bolster 60 extends transversely, substantially equidistant from the axles 36 and 46. It comprises a central depressed portion 66 carrying the ring 62, two raised end portions 68 and two sloping arms 70 connecting the central portion 66 to the end flanges 68. The ring 62 forms a ball bearing and comprises for example an inner collar 72 attached to the bogie bolster 60 and an outer collar 74 attached to the body chassis and moveable in rotation relative to the inner collar.

The portions 68 of the bogie bolster are situated in line with the median portions 76 of the side members, and are connected to said side members by the secondary suspension components 64.

Each secondary suspension component 64 comprises two resilient rubber/metal sandwiches, arranged in chevrons on either side of the corresponding flange 68. The sandwiches are of the type described in FR-1 536 401. Each sandwich 78 comprises a plurality of layers of a resilient material such as rubber parallel to one another, a plurality of intermediate metal plates inserted between the layers of resilient material and metal end plates arranged at the bottom and top of the sandwich. The intermediate plates and the end plates are parallel to one another and parallel to the layers of rubber. Each layer of rubber is therefore arranged between two metal plates and adheres to said plates. The end plates are attached rigidly, one to the flange 68 and the other to the side member 52.

The front and rear brakes 35 are disc brakes. The bogie comprises a brake for each axle. The front brake 35 is arranged towards the outside of the bogie relative to the left front wheel, in a position substantially symmetrical to that of the front reducing gear 38. It comprises a positively connected rotating disc 80 of the front axle 36 and at least one clamp 82 mounted on the chassis 22 and capable of gripping the disc 80.

The rear brake 35 is situated towards the outside of the bogie relative to the right rear wheel 26, in the extension of the rear axle 46. It too comprises a brake disc 80 integral with the rear axle 46 and a clamp 82.

The bogie also comprises two vertical shock absorbers 84 inserted between the median portions 76 of the side members and the flanges 68 of the bogie bolster and two transverse shock absorbers 85 inserted between the bogie chassis 22 and the bogie bolster 60. The bogie also comprises a substantially transverse anti-roll bar 86 (FIG. 2), connecting the two side members 52 to one another, and two vertical levers 87 connecting the anti-roll bar 86 to the two flanges 68 of the bogie bolster. The anti-roll bar 86 is engaged in the transverse bearings 88 attached to the side members 52. Moreover, rigid bars 89 (which can be seen in FIGS. 4 and 5) connect the control mechanism 90 of the brake clamps 82 to the bogie chassis 22.

Figure 12:
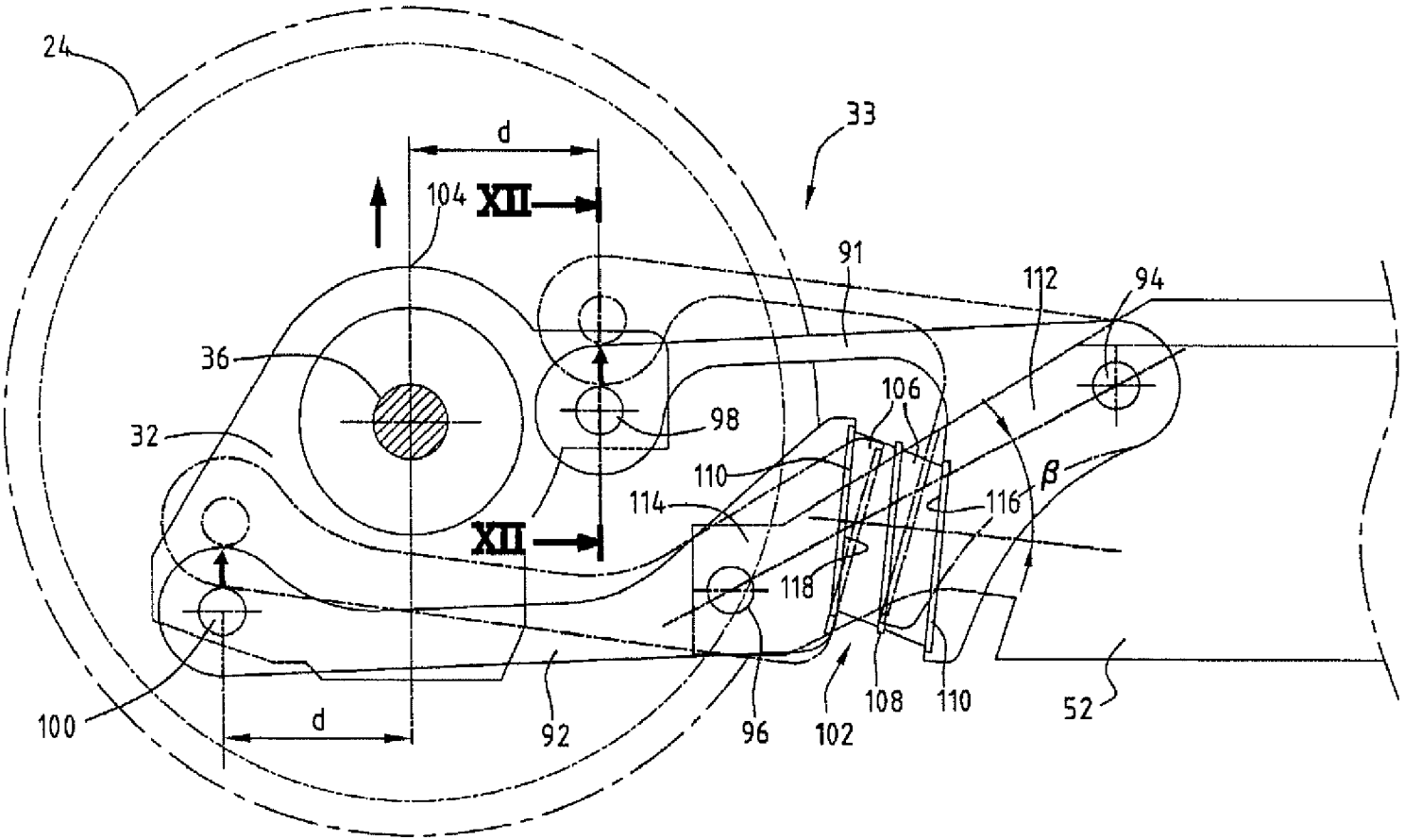
FIG. 12 is a side view of a front portion of the bogie of FIG. 1, showing in detail the structure of a low primary suspension component of said bogie, the two connecting rods of the suspension component being illustrated at rest in solid lines and in dashed and dotted lines after having been moved under the effect of vertical loading applied to the wheel from bottom to top.

As can be seen in FIGS. 2 and 12, the primary suspension devices 33 situated on both lateral sides of the bogie are so-called "low" devices.

Each primary suspension device 33 comprises:

two connecting rods 91 and 92, connected by first connection points 94 and 96 respectively to a side member 52, and by second connection points 98 and 100 respectively to the axle box 32;

a resilient component 102 inserted between the two connecting rods 91 and 92 to define at least the vertical stiffness of the primary suspension device 33.

The two connecting rods 91 and 92 are placed in the same vertical plane, in other words in a first plane perpendicular to the rolling plane of the bogie, the connecting rod 91, situated above the connecting rod 92, being referred to as the upper connecting rod and the connecting rod 92 being referred to as the lower connecting rod in the description that follows.

At rest, the two connecting rods 91 and 92 are substantially parallel to one another and extend in a longitudinal direction corresponding substantially to the direction of the side members of the chassis 22. They are therefore perpendicular to the axles 36 and 46. Between the first and second respective connection points thereof the connecting rods 91 and 92 have substantially the same longitudinal length.

As shown in FIG. 12, the two connecting rods 91 and 92 are offset longitudinally relative to one another when the primary suspension device is at rest and also when it is under load. Therefore, as shown in FIG. 12, the upper connecting rod 91 is offset to the right of FIG. 12, in other words towards the side member 52 relative to the lower connecting rod 92. In order to distribute the load between the two connecting rods 91 and 92, the second connection points 98 and 100 of the upper and lower connecting rods 91 and 92 are offset longitudinally and symmetrically on either side of the axis of the axle 36 or 46. Thus, the connection point 98 of the upper connecting rod is offset relative to the central transverse axis of the axle by a distance d towards the side member 52. Symmetrically, the connection point 100 of the lower connecting rod 92 is offset symmetrically relative to the central axis of the axle by the same distance d in the longitudinal direction, opposite the side member 52. With this arrangement, there is an even distribution of the load between the two connecting rods 91 and 92 when the resilient component 102 is centred between the connection points 94 and 96, in other words when the centre of the resilient component 102 is placed equidistant from the points 94 and 96 on the straight line passing through the two points 94 and 96.

The primary suspension device 33 is said to be "low" because at rest or under load, the connecting rods 91 and 92 are situated entirely at a vertical level lower than the highest point 104 of the axle box 32. The highest point 104 of the axle box is the point of this envelope situated highest relative to the rolling plane of the bogie. This point 104 moves in a vertical direction with the axle box 32 depending on the position of the connecting rods 91 and 92.

The resilient component 102 is a rubber-metal sandwich of the type described in patent application FR-1 536 401. The resilient component 102 comprises a plurality of rubber layers 106 parallel to one another, one or more metal plates 108 inserted between the layers of rubber 106, and metal end plates 110 arranged at the bottom and top of the sandwich. The plates 108 and 110 are parallel to one another and parallel to the layers of rubber 106. Each layer of rubber 106 is therefore arranged between two metal plates 108 and/or 110 and adheres to said plates.

The axis of compression of such a resilient component is perpendicular to the plates 108 and 110 and to the layers of rubber 106.

Such a sandwich has a defined stiffness both in compression and in shearing, in other words in response respectively to a load applied in a perpendicular direction in the plane of the plates 108, 110 and layers 106, and parallel to the plane of said plates and layers.

The upper and lower connecting rods 91 and 92 each comprise a lateral extension 112 and 114 respectively, defining mutually opposite support surfaces 116 and 118 respectively, for the resilient component 102. The resilient component 102 is held between the surfaces 116 and 118. Said surfaces 116 and 118 are parallel to one another, the end plates 110 being placed on the support surfaces and rigidly attached thereto.

The support surfaces 116 and 118 are oriented in such a way that the axis of compression of the resilient component 102 forms, in a reference position, an angle β of between 0° and 90° relative to the axis passing through the first connection points 94 and 96 of the two connecting rods. Preferably, the angle β is between 20° and 50°, and typically has a value of 30°.

The two connecting rods 91 and 92 are connected to the axle box 32 of the bogie by second connection points thereof 98 and 100 respectively by means of resilient cylindrical articulations. The two connecting rods are connected to the side member 52 at the first connection points thereof 94 and 96 respectively, also by cylindrical resilient articulations.

Figure 13:
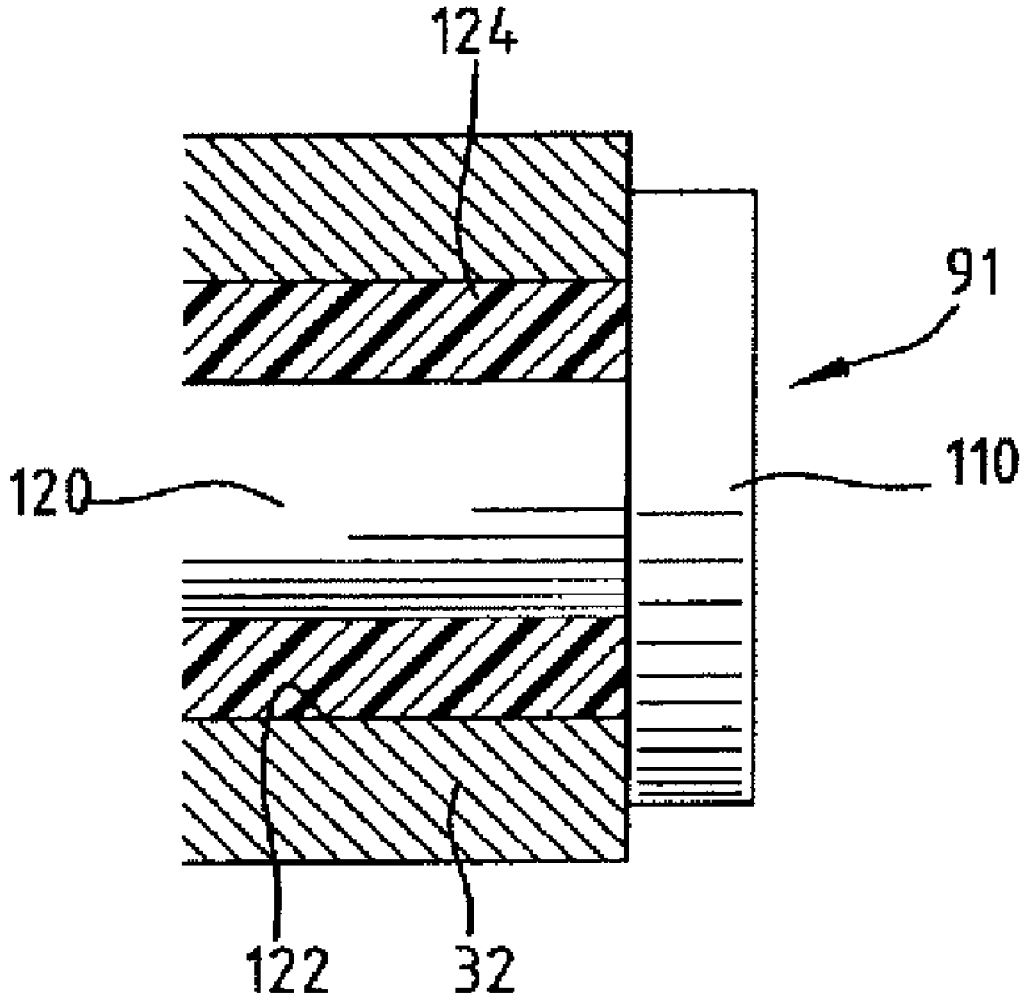
FIG. 13 is a cross-sectional view of an articulation of the upper connecting rod of FIG. 11, viewed along the incidence of the arrows XII.

The connecting rods 91 and 92 comprise at each of the connection points 94, 96, 98 and 100 a transverse axis end 120 engaged in a cylindrical opening 122 arranged, depending on circumstances, either in the axle box 32, or in the side member 52 (see FIG. 13). A cylindrical resilient sleeve 124, for example of natural or synthetic rubber, is inserted between the axis end 120 and the peripheral wall of the opening 122. The axis end 120, the opening 122 and the sleeve 124 are coaxial, with a transverse axis. The sleeve 124 adheres by an inner face to the axis end 120 and by an outer face to the peripheral wall of the opening 122.

Each primary suspension device 33 is situated, at rest and under load, entirely below a level between 200 mm and 400 mm above the rolling plane of the bogie, preferably between 250 mm and 350 mm and typically having a value of 300 mm for wheels with diameters when new of 590 mm.

The operation of the primary suspension device above will now be described briefly in relation to FIG. 12.

Under the effect of a load or a fault in the track which causes the wheel 24 to rise, the connecting rods 91 and 92 drive the axle box 32 in a vertical movement. The unit formed by the side member 52, the two connecting rods 91 and 92 and the axle box 32, connected by the connection points 94, 96, 98 and 100 forms a deformable parallelogram.

When the wheel is subject to a vertical load F from bottom to top, for example in the case of a fault in the track, the connecting rods 91 and 92 each take up part of the load F at the second connection points thereof 98 and 100 respectively, because said first connection points are placed symmetrically about the axle. The distribution of the load F between the two connecting rods 91 and 92 is a function of the position of the resilient block between the points 94 and 96.

Under the effect of this load, the connecting rods 91 and 92 pivot upwards relative to the side member 52 about the first connection points 94 and 96, in other words clockwise in FIG. 12. Under the effect of this pivoting, the support surfaces 116 and 118 tend to draw closer. In the example embodiment in FIG. 12, for which the angle β has a value of about 30°, the pivoting of the connecting rods 91 and 92 leads to both a compression load and a shearing load being applied to the resilient component 102. For an angle β of 90°, the resilient component works purely in compression. For an angle β of 0°, the resilient component works purely in shearing.

In parallel, the connecting rods 91 and 92 pivot relative to the axle box 32 about the second connection points 98 and 100, which move vertically upwards as illustrated with dashed and dotted lines in FIG. 12. Of course, the axle box 32 and the highest point thereof 104 are also subject to a vertical movement upwards, which is not illustrated in FIG. 12. The connecting rods 91 and 92 pivot clockwise in FIG. 12 relative to the axle box 32 and remain at a level lower than the highest point 104 of the axle box, which is moved upwards.

The pivoting of the connecting rods 91 and 92 leads to torsion, for each connecting rod, of the resilient sleeves 124 of the first and also the second connection point.

To allow the connecting rods 91 and 92 to be mounted on the chassis, the front and rear end portions 56 and 58 of each side member are fork shaped. Each of these end portions is divided into two end plates 125 arranged facing one another (FIG. 3). The end plates 125 are substantially perpendicular to the transverse direction. The connecting rods 91 and 92 are mounted by the respective connection points thereof 94 and 96 between the end plates 125.

As shown in FIG. 1, the body chassis 14 has a first raised portion 126 in line with the right front and rear wheels, a second raised portion 128 in line with the left front and rear wheels, and a low portion 130 between the first and second raised portions 126 and 128. The raised portions 126 and 128 extend, parallel to the principal direction, over the entire length of the bogie. Perpendicular to the principal direction, the portion 126 is wide enough to cover the front motor 28, the front reducing gear 38, the front coupling 40, the rear brake 35, and the right front 24 and rear 26 wheels. The raised portion 126 also covers a large portion of the right side member 52.

The raised portion 128 has the same width as the portion 126 and, symmetrically, covers the rear motor 30, the rear reducing gear 48, the rear coupling 50, the front brake 35, the left front 24 and rear 26 wheels and a large portion of the left side member 52.

The low portion 130 forms a circulation corridor inside the body, said corridor being substantially parallel to the principal direction. The corridor 130, viewed in a plane perpendicular to the principal direction, extends to the centre of the body, in other words midway between the two side walls of the body.

The floor 132 of the circulation corridor is situated substantially at a level of 480 mm relative to the rolling plane of the bogie, when the wheels of the bogie are considered to have a diameter as when new. As can be seen in FIG. 1, the chassis, axles, axle boxes, primary suspension components, bogie bolster and secondary suspension components are all situated entirely at a level lower than that of the floor 132. This result is obtained through the use of low primary suspension devices as described above.

The corridor 130 is about 800 mm wide, perpendicular to the principal direction. It slightly covers the two side members 52. However, a significant gap is provided between the side walls 134 of the low portion 130 and the wheels 24 and 26, to allow rotating clearance of the bogie relative to the body.

As shown in FIG. 2, each of the raised portions 126 and 128 comprises, viewed from front to rear, zones of different levels. More precisely, each portion comprises firstly a mid-level zone 138, then a zone 140 at a higher level than the zone 138, then a zone 142 at a lower level than the zone 138, then a zone 144 at the same level as the zone 140 and finally a zone 146 at the same level as the zone 138. The zone 142 extends in line with a flange 68 of the bogie bolster and with one of the motors. It is situated at an intermediate level between that of the flange 68 and the highest point of the wheels 24 and 26.

The zones 138, 140, 144 and 146, on the other hand, are all situated at a level higher than the highest point of the wheels.

As can be seen on considering FIGS. 1 and 2, two seats 20 are attached side by side in each of zones 138, 140, 144 and 146. The seats of the zones 140 and 144 face one another, the zone 142 allowing the passengers seated on these seats to rest their feet. The seats of zones 138 and 140 are arranged back to back, as are the seats in zones 144 and 146.

The ring 62 is attached beneath the floor 132 of the corridor. The face 148 of the floor 132 turned towards the ground, viewed perpendicular to the principal direction, has a profile that follows substantially that of the bogie bolster.

Figure 4:
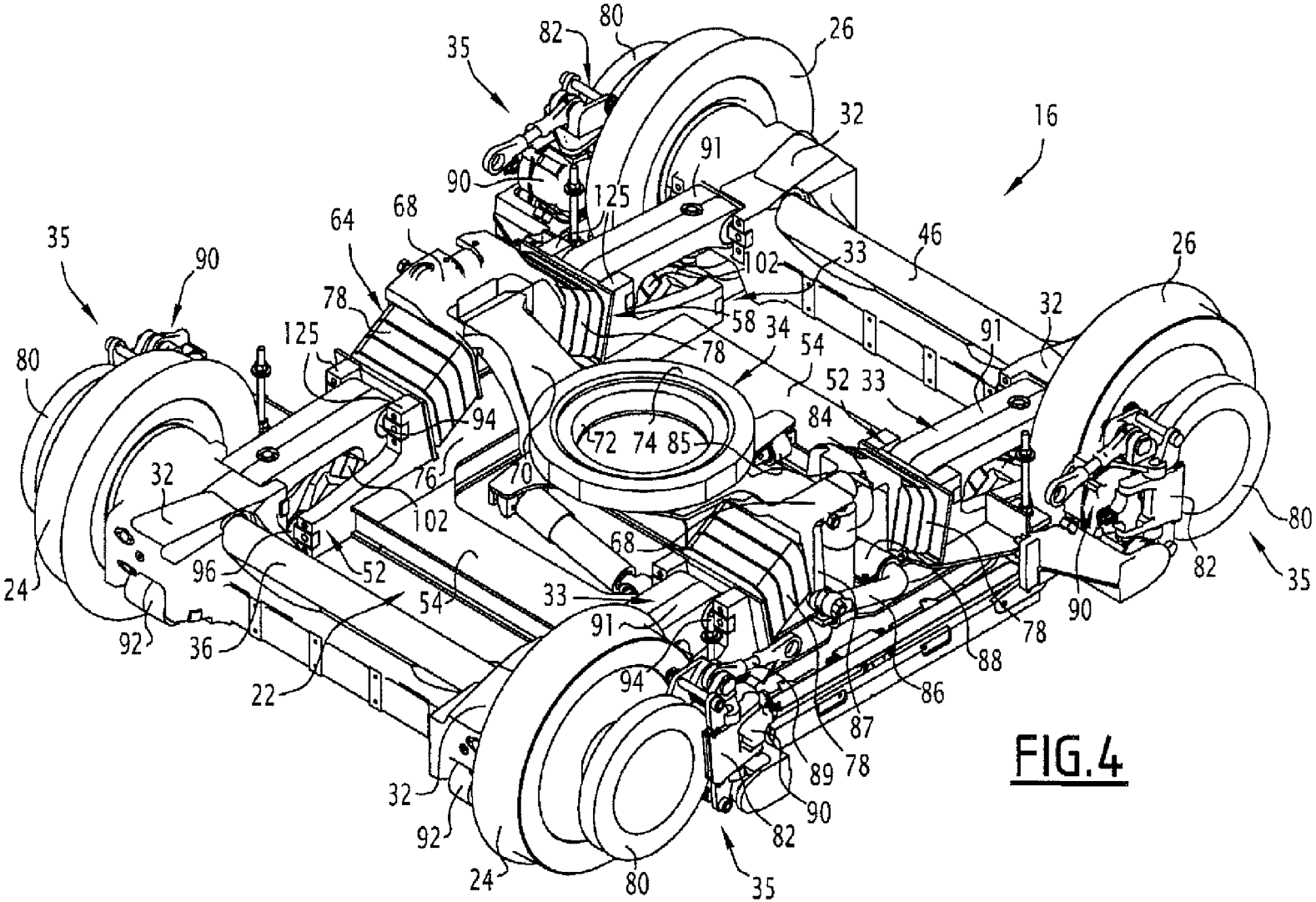
FIG. 4 is a perspective view similar to that of FIG. 3, for a non-powered variant of the bogie of FIGS. 1 to 3.

FIG. 4 illustrates a first non-powered variant embodiment of the bogie of FIGS. 1 to 3. Only differences in relation to the bogie described above will be stated here. Identical elements, or those performing the same function, will be designated by the same reference numerals.

This bogie does not comprise the front and rear motors 28 and 30, nor the front and rear reducing gears 38 and 48, nor the couplings 40 and 50. However, it does comprise two supplementary brakes 35, arranged in place of the front and rear reducing gears 38 and 48. The bogie therefore has, for each axle, two brakes 35 arranged towards the outside of the bogie relative to the wheels.

The level of the circulation corridor, the width thereof and the arrangement of the seats 20 in line with the bogie in the body are identical for this variant to that described above with reference to the embodiment of FIGS. 1 to 3.

Figure 5:
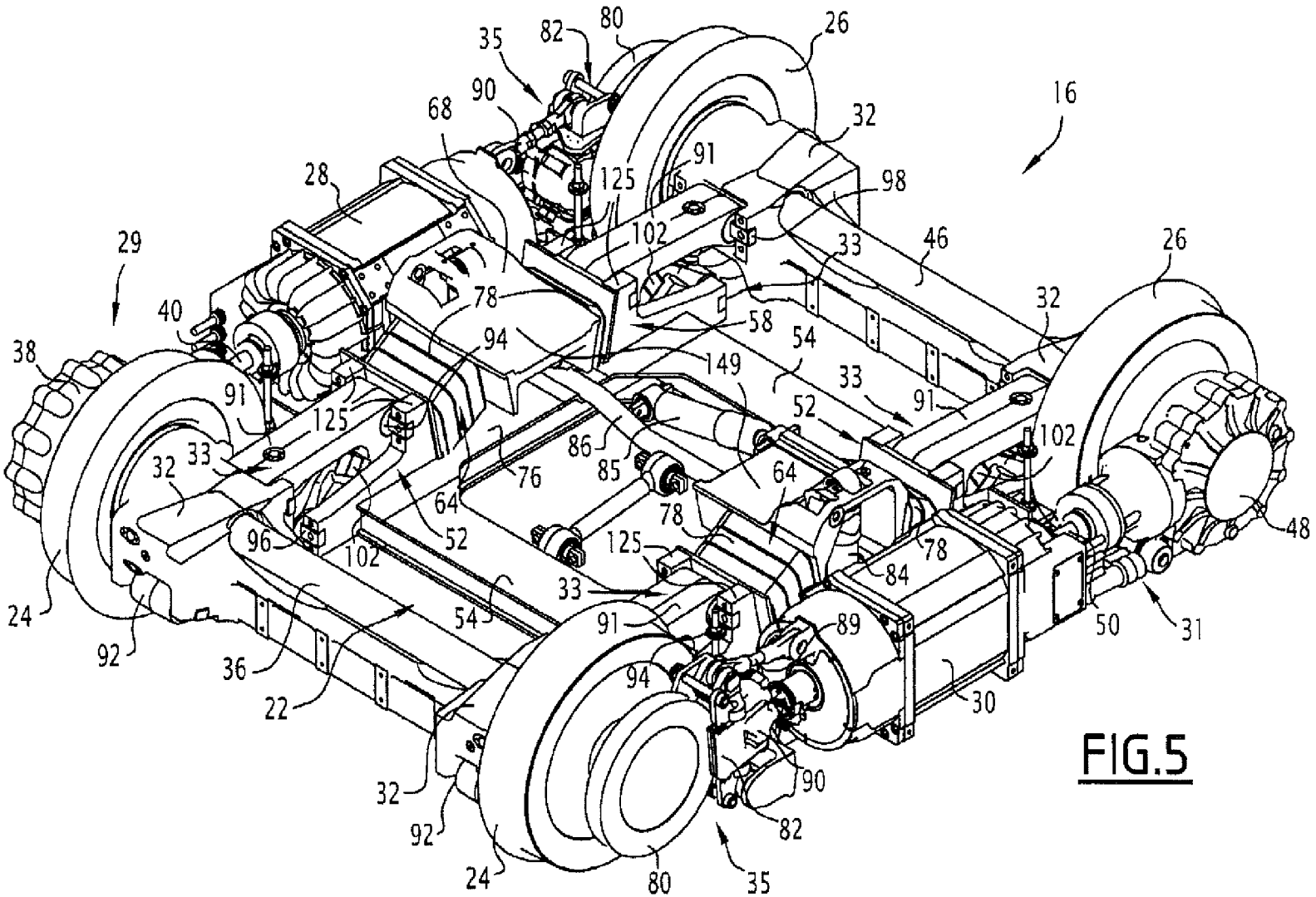
FIG. 5 is a perspective view similar to that of FIG. 3, for a non-pivoting variant of the bogie of FIGS. 1 to 3.
Figure 6:
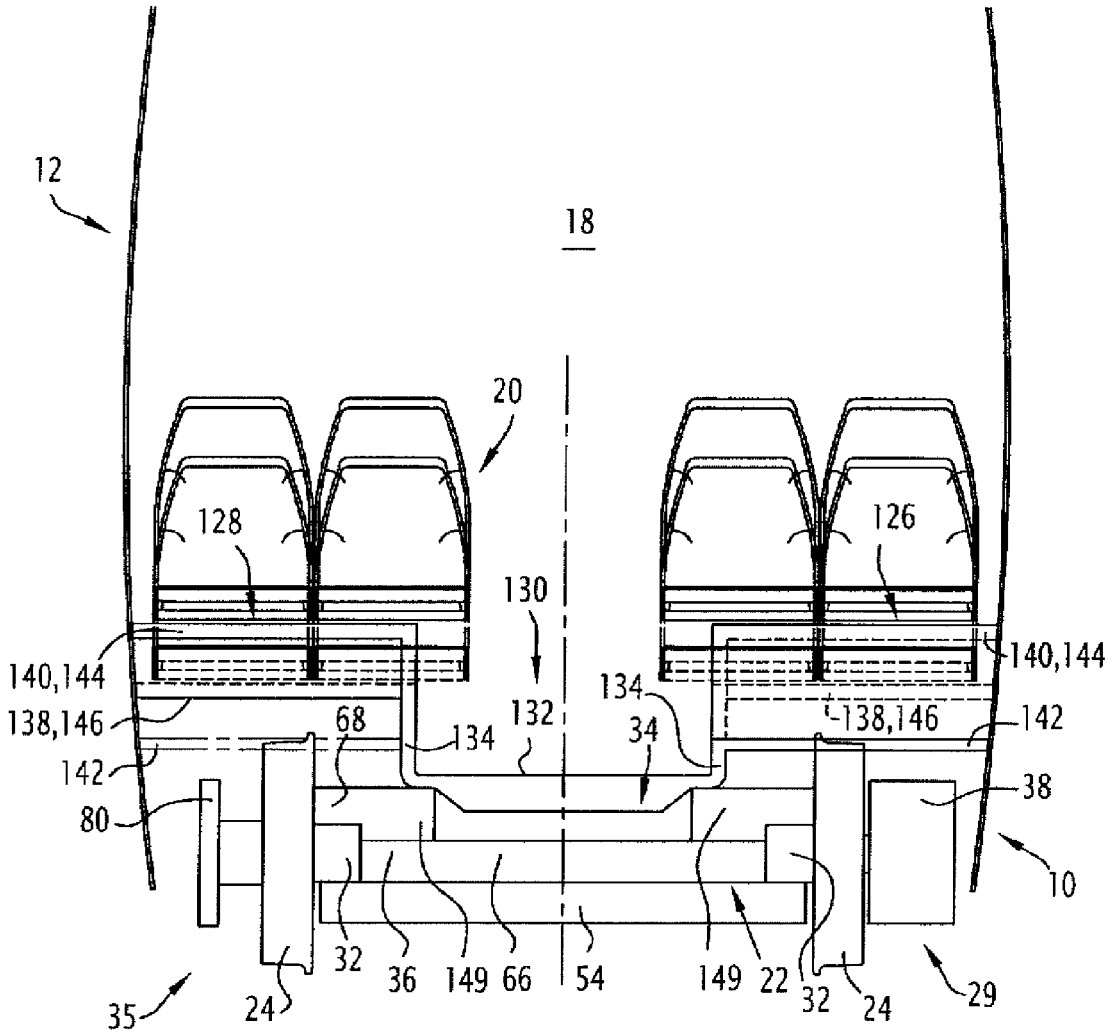
FIG. 6 is a cross-sectional view similar to that of FIG. 1, for the bogie of FIG. 5.

FIGS. 5 and 6 illustrate a second non-pivoting variant embodiment of the bogie of FIGS. 1 to 3. Only differences in relation to the bogie of FIGS. 1 to 3 will be detailed here, identical elements, or those performing the same function, being designated by the same reference numerals.

The bogie 16 does not have a bogie bolster 60 or ring 62. However, the connection means 34 between the bogie and the body comprise support flanges 149 rigidly attached to the body chassis 14 and inserted between the secondary suspension components 64 and the body chassis 14. The bogie is therefore non-pivoting, in the sense that the connection means thereof to the body only allow very limited pivoting about an axis perpendicular to the rolling plane, generally of less than 2°.

Because of the very small amount of clearance possible between the bogie and the body, the side walls 134 of the circulation corridor may be arranged much closer to the wheels than in the embodiment of FIGS. 1 to 3, corresponding to a pivoting bogie. In this case, the lowered portion 130 of the body chassis covers a large portion of the side members 52, and, perpendicular to the principal direction, is substantially one meter wide. In this case, too, the floor 132 is situated at a level of 480 mm relative to the rolling plane of the bogie, for wheels having a diameter as when new.

A second embodiment of the invention will now be described in relation to FIGS. 7 to 9. Identical elements or those performing the same function as in the first embodiment will be designated by the same reference numerals.

Only the points in which the second embodiment differs from the first will be detailed below.

Each bogie 16 comprises a single motor 150 suitable for driving both the front and rear wheels. The front reducing gear 38 is coupled to the shaft of the single motor 150 by means of the front coupling 40, the rear reducing gear 48 being coupled to the shaft of the motor 150 by means of the rear coupling 50.

Figure 7:
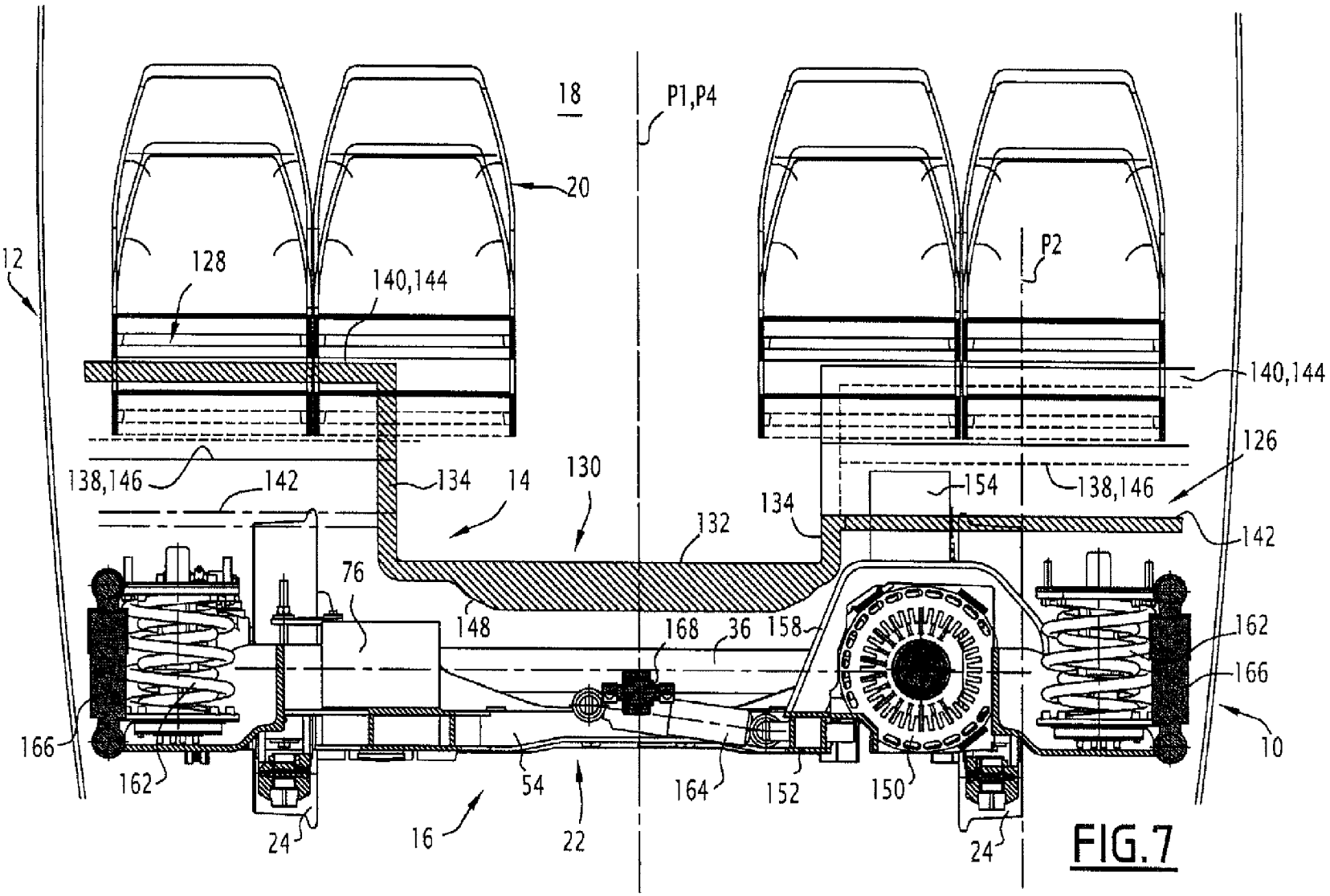
FIGS. 7, 8 and 9 are views similar to those of FIGS. 1 to 3, for a second embodiment of the invention, the bogie illustrated in FIGS. 7 to 9 being non-pivoting, the section of FIG. 8 being made along a broken line.

The motor 150, reducing gears 38 and 48 and couplings 40 and 50 are arranged between, on the one hand, a longitudinal plane P1 midway between the front wheels 24 and midway between the rear wheels 26 and, on the other hand, a plane P2 passing through the right front and rear wheels 24 and 26 (see FIG. 7). Thus, the motor 150, reducing gears 38 and 48 and couplings 40 and 50 are all arranged on the right side of the bogie, towards the inside of the bogie relative to the wheels. The reducing gears 38 and 48 are placed immediately inside the right front 24 and rear 26 wheels respectively.

Figure 9:
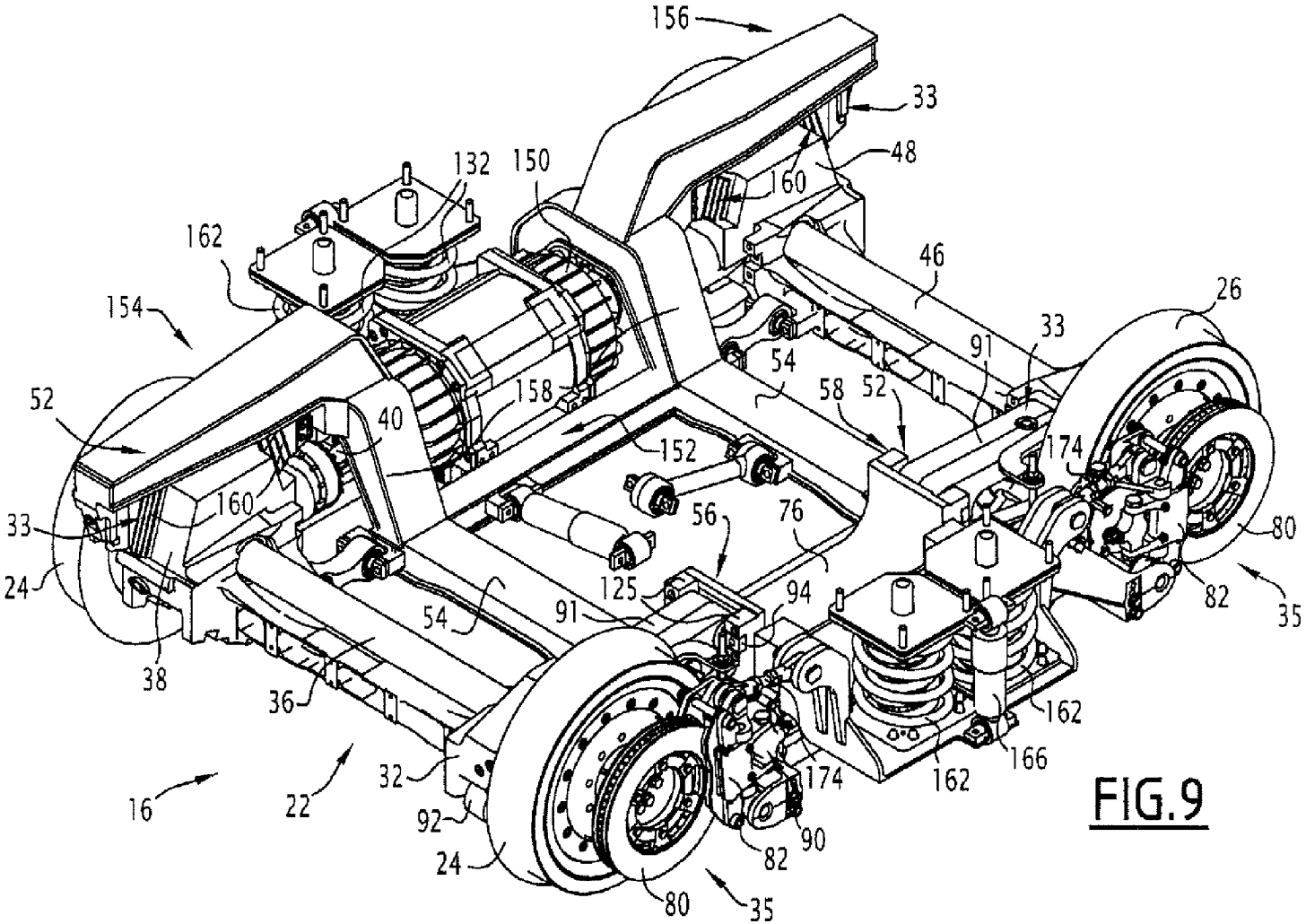

As shown in FIG. 9, the reducing gears 38 and 48 play the role of axle boxes and comprise means for guiding the front and rear axles 36 and 46 respectively in rotation, such as ball bearings. The output of the reducing gear 38 is attached directly to the right front wheel 24 or to the front axle 36. Similarly, the output of the rear reducing gear 48 is attached directly to the rear wheel 26 or to the rear axle 46.

The reducing gears 38 and 48, couplings 40 and 50, and motor 150 are aligned longitudinally. The motor 150 is placed longitudinally between the reducing gears 38 and 48, the couplings 40 and 50 being inserted respectively between the reducing gear 38 and the motor 150 and between the rear reducing gear 48 and the motor 150.

The couplings 40 and 50 each comprise a longitudinally oriented transmission shaft, connected in rotation by universal joints to the shaft of the motor 150 and to the input of the reducing gear 38 or 48.

The motor 150 is equidistant from the axles 36 and 46. Moreover, the positions of the front and rear reducing gears 38 and 48 are symmetrical to one another about a median transverse plane P3 of the front and rear wheels 24 and 26. As shown in FIG. 8, the plane P3 is equidistant from the axles 36 and 46. Similarly, the positions of the couplings 40 and 50 are symmetrical to one another about the plane P3.

The front and rear reducing gears 38 and 48 are different from one another and are chosen to drive the front and rear wheels in the same direction of rotation.

The bogie 16 is asymmetrical, the right side member 52 being different from the left side member 52, and the primary suspension device 33 associated with the right wheels being different from the primary suspension device 33 associated with the left wheels.

Figure 8:
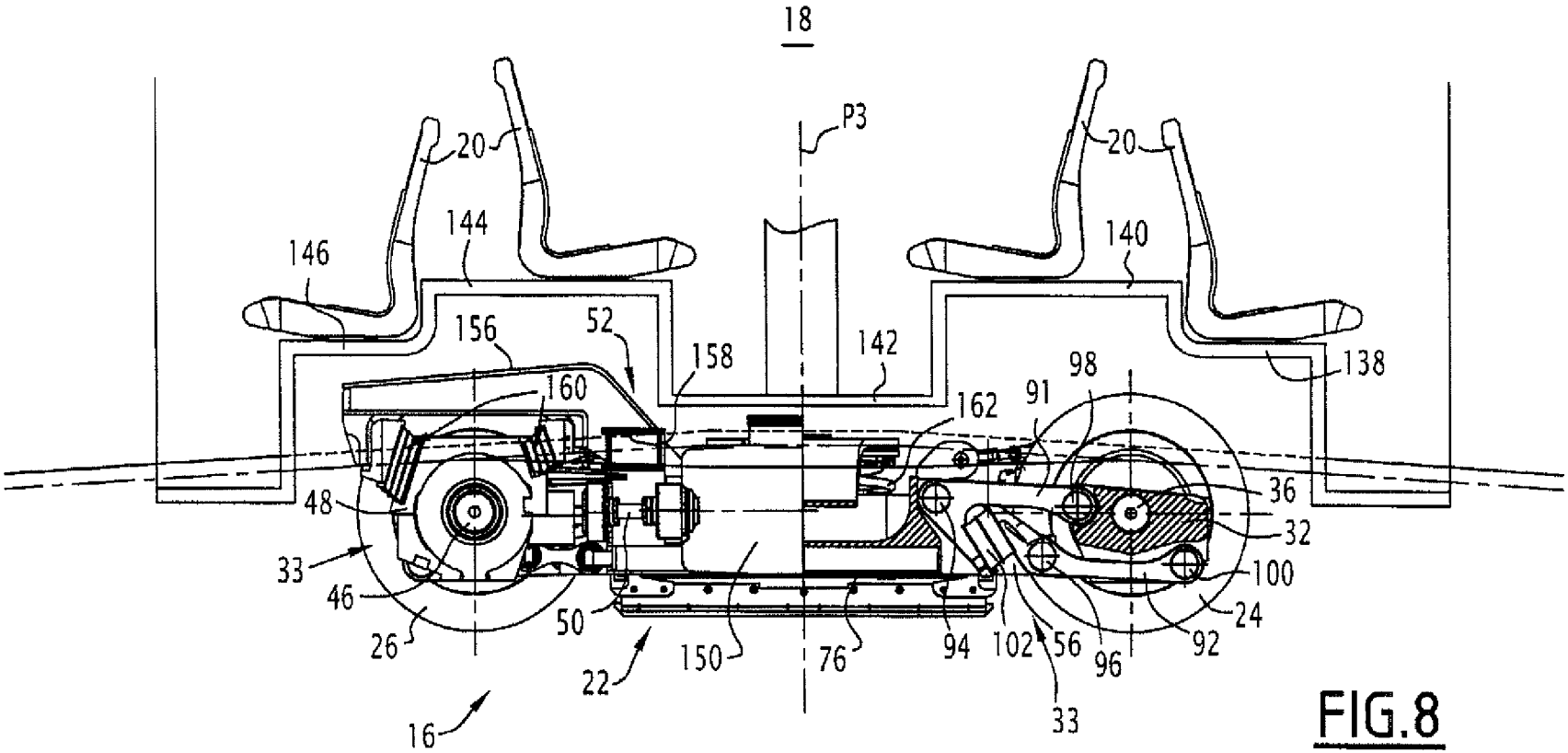

As shown in FIGS. 8 and 9, the right side member 52 comprises a low central portion 152 extending along the motor 150, and two raised end portions 154 and 156.

The left side member 52, the cross members 54 and the low portion 152 of the right side member are arranged in the same plane substantially parallel to the rolling plane of the bogie. The portion 152 is arranged towards the outside of the bogie relative to the motor 150. It extends longitudinally from one cross member 54 to the other. The motor 150 is attached rigidly to the portion 152. The motor shaft thereof is situated at the level of the axis of the axles 36 and 46, at an intermediate level between the portion 152 and the end portions 154 and 156.

The raised end portions 154 and 156 of the right side member extend longitudinally, above the front reducing gear 38 and the rear reducing gear 48 respectively. The portions 154 and 156 are attached rigidly to the central portion 152 by legs 158.

The primary suspension devices 33 associated with the right front and rear wheels each comprise two primary suspension devices 160 of the rubber/metal sandwich type (FIGS. 8 and 9). Such sandwiches are described in FR-1 536 401. Each component comprises a plurality of layers of a resilient material such as rubber, and a plurality of metal plates inserted between the layers of resilient material and adhering to said layers. Each of the components 160 is chevron-shaped.

The components 160 of the primary suspension device associated with the right rear wheel are inserted between the rear, raised portion 156 of the right side member and the rear reducing gear 48. One of the components 160 is situated in front of the axle 46, and the other to the rear of the axle 46.

Similarly, in the primary suspension device associated with the right front wheel, the components 160 are inserted between the front raised portion 154 of the right side member and the front reducing gear 38. One of the primary suspension components is situated in front of the axle 36 and the other to the rear of the axle 36.

The left side member 52 of the chassis is similar to the side members of the chassis of the first embodiment of the invention. The primary suspension devices 33 associated with the left front and rear wheels are low devices identical to the primary suspension devices of the first embodiment of the invention. They are inserted between the end portions 56 and 58 of the left side member and the axle boxes 32 of the left wheels, as described above. Each low device 33 is situated at rest entirely below a level between 200 mm and 400 mm above the rolling plane of the bogie, preferably between 250 mm and 350 mm, and typically having a value of 300 mm, for wheels with a diameter when new of 590 mm.

The bogie typically comprises four secondary suspension components 162 each comprising a spiral spring inserted between the bogie chassis 22 and the body chassis 14. The four secondary suspension components 162 are arranged symmetrically about a longitudinal plane P1 and about the plane P3. Two components 162 are placed on the right side of the bogie towards the outside of the bogie relative to the right wheels 24 and 26. The two other spiral springs are arranged on the left side of the bogie towards the outside of said bogie relative to the left wheels 24 and 26. The secondary suspension components 162 are situated longitudinally between the front 24 and rear 26 wheels. Vertically they are substantially the same size as the motor 150 and are situated at the same level as said motor relative to the rolling plane (see FIG. 7).

The front and rear brakes 35 are disc brakes of the same type as those described in relation to the first embodiment of the invention.

These brakes are arranged on the left side of the bogie, towards the outside of the bogie relative to the left front and rear wheels 24 and 26. They are arranged in the transverse extension of the front and rear axles 36 and 46.

The bogie comprises one transverse shock absorber 164 and two vertical shock absorbers 166, all inserted between the bogie chassis 22 and the body chassis 14. It also comprises a rigid longitudinal connecting rod 168 suitable for transmitting the load between the bogie chassis and the body chassis. Moreover, the actuating mechanism 90 of the brake clamps is connected to the bogie chassis by means of the connecting rods 174.

As shown in FIG. 7, the raised right portion 126 of the body chassis covers the secondary suspension components 162, the right front and rear wheels, the motor 150, the front and rear reducing gears 38 and 48 and the front and rear couplings 40 and 50.

The raised left portion 128 only covers the secondary suspension components 162, the left front and rear wheels and the front and rear brakes 35.

Viewed perpendicular to the transverse direction, the first raised portion 126 is relatively wider than the second raised portion 128. The circulation corridor 130 is therefore offset transversely towards the left raised portion 128 relative to the median plane P4 of the body 12 and extending parallel to the principal direction.

The floor 132 of the circulation corridor is situated at a level of about 480 mm relative to the rolling plane of the bogie, when considering the diameter of the wheels when new. Viewed in a plane perpendicular to the principal direction of the body, the circulation corridor 130 extends practically from the reducing gears 38 and 48 to the left wheels. It is about 900 mm wide.

As in the first embodiment of the invention, each of the raised portions of the body chassis comprises zones 138 to 146 of different levels, allowing sixteen seats to be arranged in line with the bogie.

Figure 10:
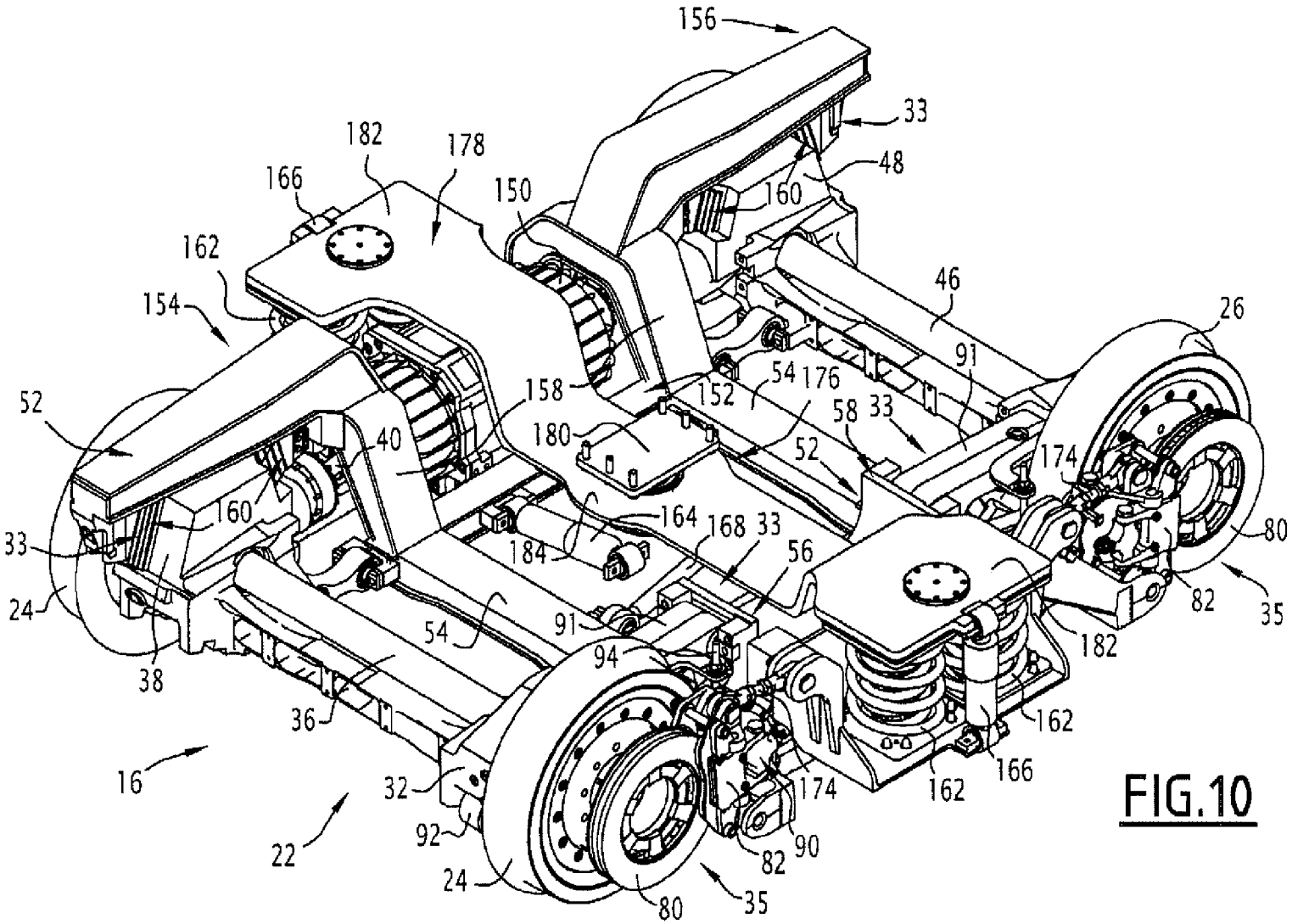
FIG. 10 is a perspective view similar to that of FIG. 9, for a pivoting variant of the second embodiment of the invention.
Figure 11:
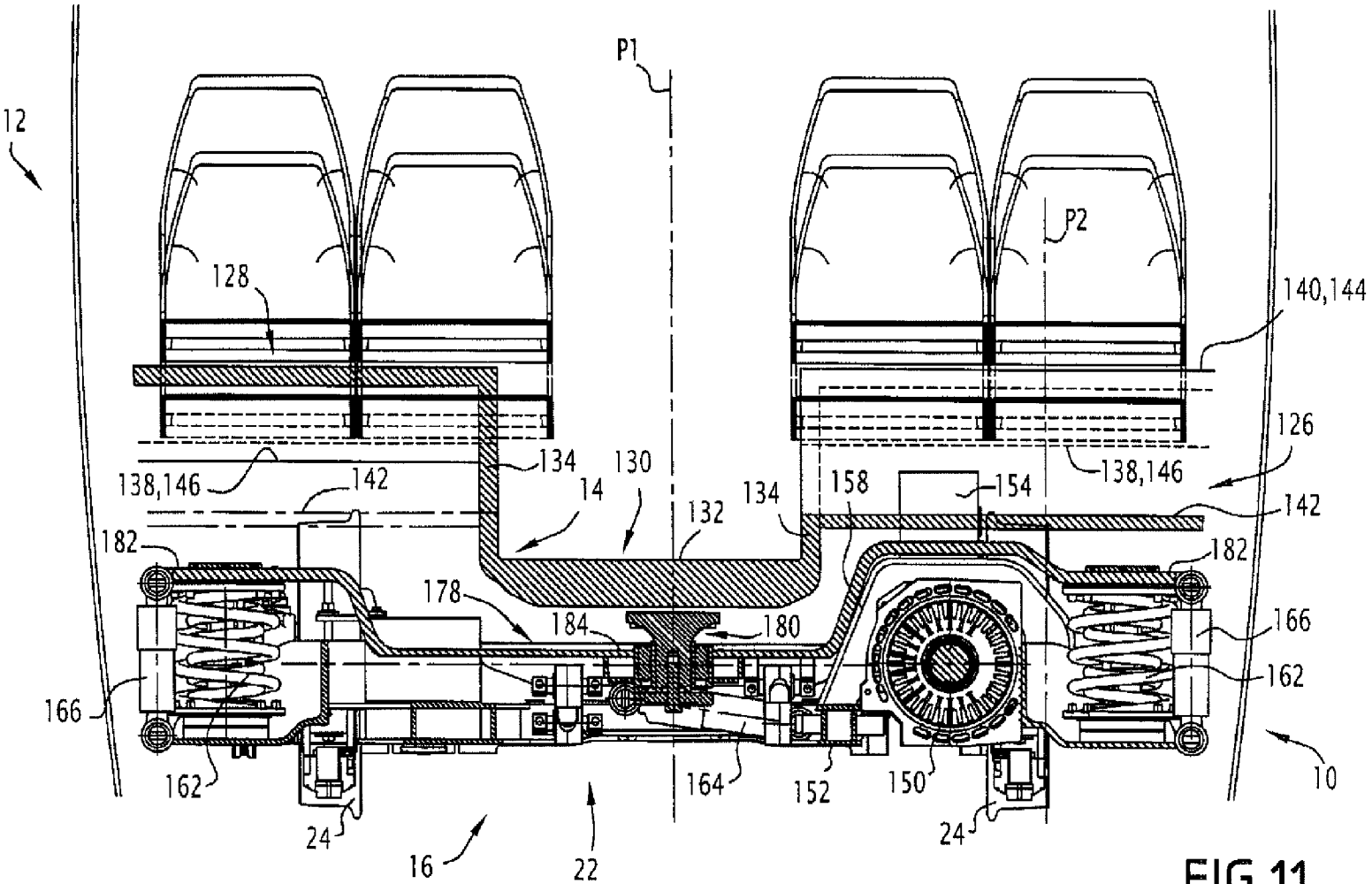
FIG. 11 is a cross-sectional view similar to that of FIG. 7, for the pivoting bogie of FIG. 10.

FIG. 10 illustrates a pivoting variant embodiment of the bogie of FIGS. 7 to 9. Only the differences in relation to the bogie of FIGS. 7 to 9 will be stated here. Identical elements, or those performing the same function, will be designated by the same reference numerals.

The bogie 16 comprises pivot connection means 176 suitable for connecting the bogie to the body 12. The means 176 comprise a transverse bogie bolster 178 and a pivot 180 inserted between the bolster 178 and the body chassis 14. The pivot 180 has an axis of rotation substantially perpendicular to the rolling plane of the bogie.

The bolster 178 has a cradle shape similar to that of the bolster 60 of the first embodiment. The raised end portions 182 of the bogie bolster are flange-shaped. The secondary suspension components 162 are inserted between the flanges 182 and the chassis 22. The pivot 180 is connected to the low central portion 184 of the bogie bolster.

The floor 132 of the corridor 130 is situated at a level about 520 mm above the rolling plane of the bogie, when considering the diameter of the wheels when new. The corridor 130 is only about 660 mm wide, perpendicular to the principal direction of the body, so as to leave a free space between the lateral walls 134 of the corridor and the components of the bogie allowing rotating clearance of the bogie relative to the body.

The bogies described above have many advantages.

The use of a low primary suspension allows a low, particularly wide, circulation corridor to be arranged in the body chassis, even when the bogie is mounted by pivot connection means beneath the body.

Because the reducing gears have outputs attached directly to the wheels, the front and rear couplings are arranged longitudinally between the motors and the reducing gears. The transverse size of the motor transmission towards the wheels is reduced.

Moreover, the output shafts of the motors are longitudinal, which allows the gear wheels of the reducing gears to be reduced compared with motors with transverse output shafts.

Because the primary suspensions are placed towards the inside of the bogie relative to the wheels, it is possible to lower the side walls of the body substantially to the axis of the wheels, or even lower, while giving them a curved shape. As shown in FIGS. 1 and 7, the walls are not flat but, on the contrary, are slightly rounded towards the outside of the body.

Moreover, this arrangement of the primary suspensions facilitates access to the wheels and brake discs to maintain or replace them.

In the first embodiment of the invention, the fact that the motors and reducing gears are placed towards the outside of the bogie relative to the wheels and the fact that the chassis and the axle boxes are arranged in the same plane, substantially parallel to the rolling plane of the bogie, further facilitate the arrangement of a low, wide circulation corridor in the body chassis.

Furthermore, the fact that the motors are placed towards the outside of the bogie, vertically at the level of the bogie chassis, and the fact that the secondary suspensions are placed inside the bogie relative to the wheels, at the same level as the motors, allows two low side zones to be formed in the body chassis between the front and rear wheels of the bogie. It therefore becomes possible to arrange sixteen seats in the body above each bogie. In fact, two seats may be arranged in front of each low zone and two others to the rear of said low zone, facing the front seats. The low zones serve to accommodate the legs of the passengers seated on the four facing seats.

The second embodiment of the invention also has many advantages.

The fact that the motor and the reducing gears are assembled on a lateral side of the bogie, opposite the low primary suspension components, further facilitates the arrangement of a circulation corridor that is both low and wide in the body chassis.

The symmetrical arrangement of the motor or motors and reducing gears relative to the median transverse plane of the wheels also assists in this regard.

The driving motor of the bogie may advantageously be aligned longitudinally between the two reducing gears. The or each motor and the reducing gears have substantially the same dimensions transversely, so that there is a large free space between the motor and the reducing gears, on the one hand, and the wheels situated on the opposite side of the bogie, on the other hand, to allow the circulation corridor to pass through the body.

Because the reducing gears are assembled on the same side of the bogie, the circulation corridor is offset relative to the median plane of the body and parallel to the principal direction of the body.

In this case, the brakes and secondary suspension springs of the bogie are placed towards the outside of the bogie relative to the wheels, so as not to impede the passage of the body circulation corridor.

The fact that the motor is placed along a low central portion of the right side member, towards the outside of the bogie, and the fact that the motor is placed at a level lower than that of the raised end portions of the right side member allow two low side zones to be formed in the body chassis between the front and rear wheels of the bogie.

It therefore becomes possible to arrange up to four rows of three seats without encroaching too far on the corridor for a narrow body (less than 2400 mm wide), or twelve seats above the bogie. In this case, two seats in each row are arranged above the wider raised portion 126, and only one above the narrower raised portion 128. In the case of a wider body (more than 2400 mm wide), it is possible to arrange four rows of four seats above the bogie without encroaching too far on the corridor, or sixteen seats in total. In this case, two seats in each row are arranged above the raised portion 126 and two more above the raised portion 128. The seats in the central rows are arranged facing one another at the front and rear of the low zones, so that passengers can accommodate their legs in the low zones.

The architecture of the bogie allows said bogie to be mounted on the body either pivoting about a pivot substantially perpendicular to the rolling plane of the vehicle, or not pivoting, in other words with an angular clearance of less than or equal to 2° relative to the body.

The bogies described above may also have many variants.

The bogie may be a carrier bogie, in other words without a motor.

The bogie may be pivoting or non-pivoting, it being possible in the latter case to increase the width of the circulation corridor arranged in the body chassis above the bogie.

The front and rear axles may be of the coupled type, as described in EP-0 911 239, or of the uncoupled type, as described in the patent application with the filing number FR 06 00834. In both cases, it is possible to reduce the height of the circulation corridor below 480 mm.

The secondary suspension components may be of any type, and comprise rubber/steel sandwiches or spiral springs. The bogie may comprise two or four secondary suspension components.

The brakes are not necessarily disc brakes, but may be of any type, for example drum brakes.

The bogie bolster may be connected to the body chassis by a ring, pivot or similar component.

In the first embodiment, the bogie may be equipped with low primary suspensions on one side only, either right or left.

It may comprise only one motor. In this case, the two reducing gears are arranged on the same side of the bogie, towards the outside of the bogie relative to the sets of carriages, the motor being coupled to both reducing gears.

In the second embodiment, the bogie may comprise two motors, each driving two wheels associated with the same axle. In this case, both motors are aligned longitudinally between the reducing gears.

The invention claimed is:

1. A bogie for a railway vehicle, the bogie comprising:

a chassis;

two front wheels and two rear wheels, the two front wheels being offset longitudinally from the two rear wheels; and for each front wheel and each rear wheel, a guide for guiding said wheel in rotation and a primary suspension device of the chassis on said guide;

at least the primary suspension devices associated with the front and rear wheels provided on the same first lateral side of the bogie each comprising:

two longitudinal connecting rods, each connected to the chassis by a first connection point and to the corresponding guide by a second connection point, and at least one resilient component inserted between the two connecting rods to define at least the vertical stiffness of the primary suspension device, the two connecting rods being offset longitudinally from one another, each second connection point between each of the two longitudinal connecting rods and the corresponding guides being exclusive of the at least one resilient component and the chassis.

2. The bogie according to claim 1, wherein in each of said primary suspension devices, the two rods are substantially parallel to one another and are of substantially the same longitudinal length between the respective first and second connection points thereof.

3. The bogie according to claim 1, wherein in each of said primary suspension devices, the at least one resilient component is a sandwich comprising a plurality of layers of a resilient material and a plurality of metal plate inserted between the layers of resilient material and adhering to said resilient layers.

4. The bogie according to claim 1, wherein in each of said primary suspension devices, the at least one resilient component has an axis of compression forming an angle of between 20° and 60° relative to an axis passing through the first connection points of the two connecting rods.

5. The bogie according to claim 1, wherein in each of said primary suspension devices, each of the two connecting rods is connected to the guide corresponding to the second connection point thereof by a resilient cylindrical articulation, and to the chassis by the first connection point thereof, likewise by a resilient cylindrical articulation, the resilient cylindrical articulations being distinct from the at least one resilient component.

6. The bogie according to claim 1, wherein the two connecting rods of each of said primary suspension devices are arranged at a vertical level lower than the highest point of the corresponding guide.

7. The bogie according to claim 1, wherein each primary suspension device is arranged on a side of the associated wheel facing the inside of the bogie.

8. The bogie according to claim 1, wherein the body comprises two longitudinal side members arranged towards the inside of the bogie relative to the wheels.

9. The bogie according to claim 8, wherein the side members and the guides of the wheels are arranged substantially in the same plane parallel to the rolling plane of the bogie.

10. The bogie according to claim 9, wherein each side member extends between two guides, said side member having front and rear end portions aligned with and terminating longitudinally at a distance from the two guides.

11. The bogie according to claim 9, further comprising at least one motor and a device suitable for coupling in rotation at least one wheel of the bogie to the at least one motor, the at least one motor and the coupling device-being arranged on a side of the wheels facing the outside of the bogie.

12. The bogie according to claim 9, further comprising two motors and two devices each suitable for coupling in rotation a pair of wheels of the bogie to a motor, one of the two motors and one of the two coupling devices being arranged towards the outside of the bogie relative to the wheels situated on the first lateral side of the bogie, the other of the two motors and the other of the two coupling devices being arranged towards the outside the bogie relative to the wheels situated opposite the first lateral side of the bogie.

13. The bogie according to claim 12, wherein one of the two motors is coupled to the two front wheels and the other of the two motors is coupled to the two rear wheels.

14. The bogie according to claim 8, further comprising at least one motor a front coupler coupling the front wheels to the at least one motor, and a rear coupler coupling the rear wheels to the at least one motor, the at least one motor and the front and rear couplers being arranged between, on the one hand, a longitudinal plane midway between the two front wheels and midway between the two rear wheels and, on the other hand, a longitudinal plane passing through the front wheel and the rear wheel situated on the second lateral side of the bogie.

15. The bogie according to claim 14, wherein the front and rear couplers are arranged in positions symmetrical to one another about a median transverse plane of the front and rear wheels.

16. The bogie according to claim 14, wherein the at least one driving motor includes a single driving motor aligned longitudinally between the front and rear couplers.

17. The bogie according to claim 14, further comprising braking elements for the front and rear wheels and secondary suspension components suitable for suspending a railway vehicle body on the bogie chassis, the braking elements and the secondary suspension components being positioned outside the bogie relative to the wheels.

18. The bogie according to claim 14, wherein the side member on the second lateral side of the bogie comprises a central portion extending along the motor and two end portions situated, relative to the rolling plane of the bogie, at a higher level than the central portion, the end portions extending above the guide for guiding in rotation the wheels situated on the second lateral side of the bogie, the motor being situated at a level lower than that of the end portions relative to the rolling plane of the bogie.

19. The bogie according to claim 18, wherein the side member situated on the first lateral side of the bogie and the guide of the wheels situated on the first lateral side of the bogie extend substantially in the same plane parallel to the rolling plane of the bogie.

20. The bogie according to claim 1, further comprising a pivot connector suitable for connecting the bogie to the body of the railway vehicle.

21. Railway vehicle comprising at least one bogie according to claim 1.

22. The railway vehicle according to claim 1, wherein each longitudinal connecting rod is directly connected to the chassis at the respective first connection point and each longitudinal connecting rod is directly connected to the corresponding guide at the respective second connection point.

23. The railway vehicle according to claim 1, wherein the resilient member is engaged between two abutment surfaces of the two connecting rods, the two abutment surfaces being distinct from the first and second connection points.

24. The railway vehicle according to claim 3, wherein the at least one resilient component has a compression axis which forms an angle with respect to an axis which extends through the first connection points of the two connecting rods such that a forces acting upon the resilient member when the guide is subject to a vertical force are both compression and shearing forces.

* * * * *